US011828011B2

(12) United States Patent
Pittman et al.

(10) Patent No.: US 11,828,011 B2
(45) Date of Patent: Nov. 28, 2023

(54) NEEDLE BAR TENSIONING APPARATUS

(71) Applicant: COLUMBIA INSURANCE COMPANY, Omaha, NE (US)

(72) Inventors: Paul Pittman, Dalton, GA (US); Terry Honeycutt, Dalton, GA (US); Michael Runyon, Dalton, GA (US); Dusty Jones, Dalton, GA (US); David Voyles, Cleveland, TN (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 276 days.

(21) Appl. No.: 17/241,674

(22) Filed: Apr. 27, 2021

(65) Prior Publication Data

US 2021/0332517 A1 Oct. 28, 2021

Related U.S. Application Data

(60) Provisional application No. 63/015,849, filed on Apr. 27, 2020.

(51) Int. Cl.
*D05C 11/06* (2006.01)

(52) U.S. Cl.
CPC ..... *D05C 11/06* (2013.01)

(58) Field of Classification Search
CPC ..... D05C 11/06; D05C 11/08; D05C 13/00; D05C 15/08; D05C 15/10; D05C 15/12; D05C 15/20
See application file for complete search history.

(56) References Cited

U.S. PATENT DOCUMENTS

| | | | | |
|---|---|---|---|---|
| 4,465,001 | A | 8/1984 | Ingram | |
| 4,662,291 | A | 5/1987 | Bardsley | |
| 5,979,344 | A * | 11/1999 | Christman, Jr. | D05C 15/28 112/80.23 |
| 9,260,810 | B2 * | 2/2016 | Neely | D05C 15/30 |
| 2008/0236464 | A1 | 10/2008 | Brewer | |
| 2019/0136429 | A1 | 5/2019 | Neely et al. | |

OTHER PUBLICATIONS

Search Report and Written Opinion of International Search Authority for PCT/US21/29394 dated Aug. 4, 2021.

* cited by examiner

*Primary Examiner* — Nathan E Durham
(74) *Attorney, Agent, or Firm* — BALLARD SPAHR LLP

(57) ABSTRACT

A shifter adjustment assembly can be configured to couple to a shifter of a tufting apparatus, the shifter having first, second, third, and fourth shaft segments. The shifter adjustment assembly comprises a first body that is configured to couple to respective first ends of the first and third shaft segments. A second body is configured to couple to respective first ends of the second and fourth shaft segments. The shifter assembly comprises a coupling between the first body and the second body. The coupling is configured to releasably secure an axial position of the first body with respect to the second body along the longitudinal dimension. The first body and second body define respective complementary surfaces that are configured for sliding engagement so that movement between the first body and the second body in the transverse dimension is restricted and movement between the first body and the second body in the longitudinal dimension is permitted.

20 Claims, 10 Drawing Sheets

NEEDLE BAR TENSIONING APPARATUS

CROSS-REFERENCE TO RELATED APPLICATION

This application claims priority to and the benefit of the filing date of U.S. Provisional Application No. 63/015,849, filed Apr. 27, 2020, the entirety of which is hereby incorporated by reference herein.

FIELD

The disclosed invention relates to tufting machines and, in particular, to apparatus and methods for adjusting the needle bars of tufting machines.

BACKGROUND

Tufting machines, such as, for example, conventional Card-Monroe tufting machines, comprise a needle bar having a plurality of needles that are reciprocally plunged through backing to make a tufted article. A corresponding hook bar can comprise a plurality of hooks, or "loopers," that engage the yarn from respective needles to form yarn loops. A needle bar shifter assembly can be coupled to each needle bar to shift the needle bar transversely to the movement direction of the backing material in order to form patterns in the tufted article. The needle bar shifter assembly can comprise a slide assembly that is coupled to a carriage assembly, and the needle bar can, in turn, be coupled to the carriage assembly. An actuator can shift the slide assembly transversely, thereby driving the carriage assemblies transversely. One embodiment of a shifter assembly is disclosed in U.S. Pat. No. 5,979,344, granted Nov. 9, 1999 to William M. Christman, Jr., the entirety of which is hereby incorporated by reference herein.

Conventional needle bar assemblies used in shifted tufting processes require periodic position adjustment relative to the hook bar in order to maintain a select positioning of the needles relative to the respective hooks. The desired spatial relationship between the needles and respective hooks can change based on the different types of yarn being used.

Although tufting machines typically have an adjustment (tensioning) system, a technician using a standard wrench can only access such tensioning systems from a guarded area, thereby slowing the tensioning process. Moreover, technicians frequently use a hammer and/or punch or specialized (crow's foot) wrenches in order to adjust the tension of the needle bar shifter assembly. However, the use of these tools creates additional safety concerns and damages the shifter shaft of the tufting machine. Moreover, the conventional tensioning system uses a coarse thread pitch, so adjustment via the conventional tensioning machine is correspondingly coarse. Thus, the conventional tensioning system lacks precision.

SUMMARY

Described herein, in various aspects, is a shifter adjustment assembly that is configured to couple to a shifter of a tufting apparatus. The shifter can have first, second, third, and fourth shaft segments. Each of the first, second, third, and fourth shaft segments can have respective first and second ends, the first and second shaft segments being aligned and spaced apart in a longitudinal dimension, the third and fourth shaft segments being aligned and spaced apart in the longitudinal dimension, the first ends of the first and second shaft segments facing one another, the first ends of the third and fourth shaft segments facing one another. The third and fourth shaft segments can be offset from the first and second shaft segments in a transverse dimension that is perpendicular to the longitudinal dimension. The shifter adjustment assembly can comprise a first body that is configured to couple to the first ends of the first and third shaft segments. A second body can be configured to couple to the first ends of the second and fourth shaft segments. The shifter adjustment assembly can comprise a coupling between the first body and the second body. The coupling can be configured to releasably secure an axial position of the first body with respect to the second body along the longitudinal dimension. The first body and second body can define respective complementary surfaces that are configured for sliding engagement so that movement between the first body and the second body in the transverse dimension is restricted and movement between the first body and the second body in the longitudinal dimension is permitted.

The shifter adjustment assembly can further comprise an adjustment device configured to move the first body with respect to the second body in the longitudinal dimension.

The first body can define a first through-hole that extends through the first body in the longitudinal dimension. The second body can define a second through-hole that extends through the second body in the longitudinal dimension. The first through-hole can define a right-hand thread. The second through-bole can define a left-hand thread. The adjustment device can comprise an elongate rod having a right-hand thread on a first end and a left-hand thread on a second end opposite the first end. The right-hand thread of the first end of the elongate rod can be in engagement with the right hand thread of the first through-hole, and the left-hand thread of the second end of the elongate rod can be in engagement with the left-hand thread of the second through-hole.

The shifter adjustment assembly can further comprise a hexagonal head coupled to the elongate rod.

The adjustment device can further comprise a jam nut that is threadedly movable on the elongate rod and configured to bias against one of the first body or the second body.

The first body can comprise a first portion and a second portion that is coupled to the first portion. The first portion of the first body can define the first through-hole that defines the right-hand thread. The second body can comprise a first portion and a second portion that is coupled to the first portion. The first portion of the second body can define the second through-hole that defines the left-hand thread.

The first portion of the first body can extend upwardly from the second portion of the first body. The first portion of the second body can extend upwardly from the second portion of the second body.

The coupling between the first body and the second body can comprise at least one fastener.

One of the first body and the second body can define at least one slot that is elongate in the longitudinal dimension, wherein each fastener of the at least one fastener extends through a respective slot of the at least one slot.

The first body can define a first longitudinally extending through-bore for receiving the first shaft segment. The first body can define a second longitudinally extending through-bore for receiving the third shaft segment.

The first body can define a first slit that extends between a first side of the first body and the first longitudinally extending through-bore. The first body can define a second slit that extends between a second side of the first body and the second longitudinally extending through-bore. The shifter adjustment assembly can comprise at least one threaded fastener that extends across the first slit of the first body. The at least one threaded fastener that extends across the first slit of the first body can threadedly couple to the first body so that a tightening of the at least one threaded fastener that extends across the first slit of the first body causes the first longitudinally extending through-bore to tighten against the first shaft segment. The shifter adjustment assembly can comprise at least one threaded fastener that extends across the second slit of the first body. The at least one threaded fastener that extends across the second slit of the first body can threadedly couple to the first body so that a tightening of the at least one threaded fastener that extends across the second slit of the first body causes the second longitudinally extending through-bore to tighten against the third shaft segment.

The second body can define a first longitudinally extending through-bore for receiving the second shaft segment. The second body can define a second longitudinally extending through-bore for receiving the fourth shaft segment.

The second body can define a first slit that extends between a first side of the second body and the first longitudinally extending through-bore. The second body can define a second slit that extends between a first edge of the second body and the second longitudinally extending through-bore. The shifter adjustment assembly can comprise at least one threaded fastener that extends across the first slit of the second body. The at least one threaded fastener that extends across the first slit of the second body can threadedly couple to the first body so that a tightening of the at least one threaded fastener that extends across the first slit of the second body causes the first longitudinally extending through-bore to tighten against the second shaft segment. The shifter adjustment assembly can comprise at least one threaded fastener that extends across the second slit of the second body. The at least one threaded fastener that extends across the second slit of the second body can threadedly couple to the first body so that a tightening of the at least one threaded fastener that extends across the second slit of the second body causes the second longitudinally extending through-bore to tighten against the fourth shaft segment.

The first body can define one of a tongue or a groove, and the second body can define the other of the tongue and the groove. The tongue can be receivable into the groove with a clearance in the transverse dimension between the groove and the tongue that inhibits transverse movement between the tongue and the groove.

The tongue can define first and second longitudinally extending outer edges. The groove can define corresponding first and second longitudinally extending inner edges that are outward of the respective outer edge of the first and second outer edges of the tongue relative to the transverse dimension. The first and second outer edges of the groove can respectively slidingly engage the first and second inner edges of the tongue to thereby restrict movement between the first body and the second body in the transverse dimension.

The shifter adjustment assembly can further comprise a linear position sensor that is configured to detect at least one of a distance or a change in distance between the first body and the second body relative to the longitudinal dimension.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
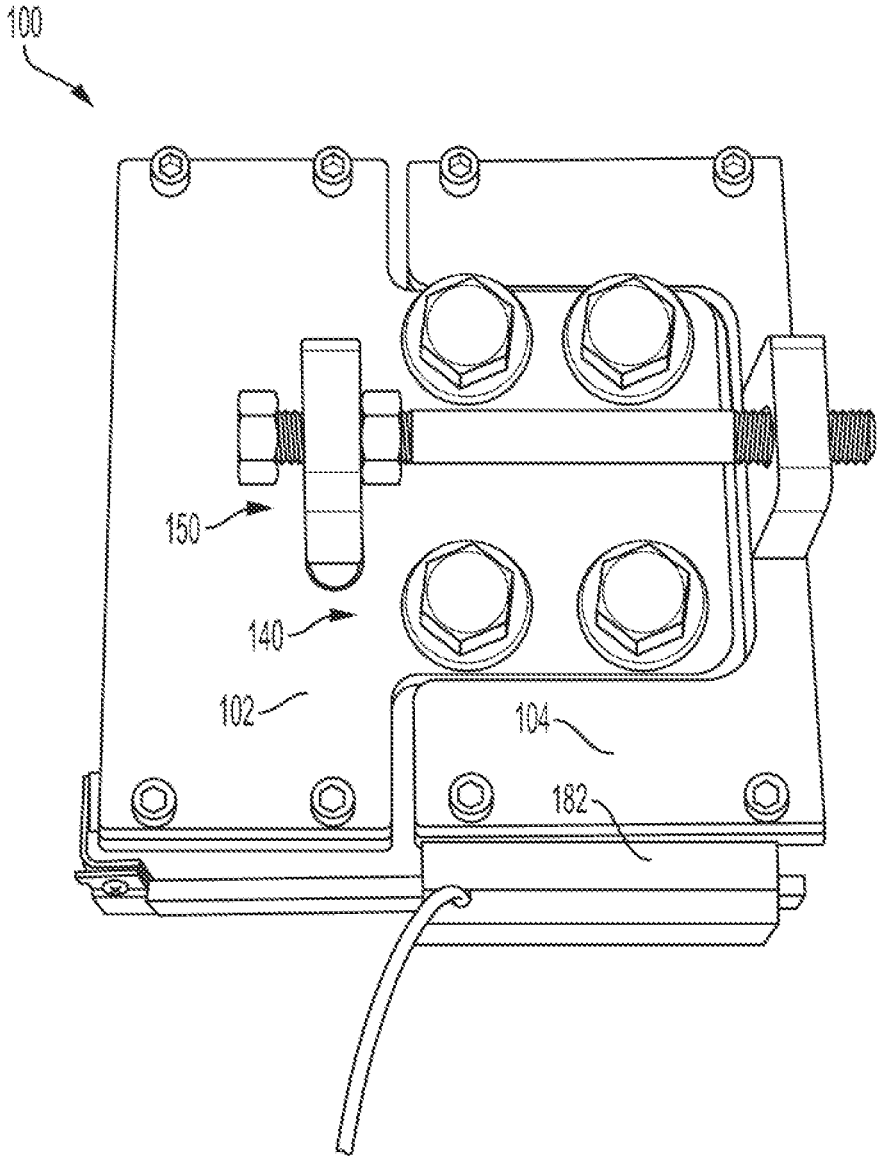
FIG. 1 is a perspective view of a shifter adjustment apparatus, in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a screw" can refer to one or more of such screws, and so forth.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, in some optional aspects, when values are approximated by use of the terms "substantially" or "generally," it is contemplated that values within up to 15%, up to 10%, up to 5%, or up to 1% (above or below) of the particular value can be included within the scope of those aspects. When used with respect to an identified property or circumstance, "substantially" or "generally" can refer to a degree of deviation that is sufficiently small so as to not measurably detract from the identified property or circumstance, and the exact degree of deviation allowable may in some cases depend on the specific context.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with an other apparatus and techniques conventionally used in the industry.

Disclosed herein, in various aspects and with reference to FIGS. 11-14 is a shifter adjustment assembly 100 for use with a needle bar shifter assembly 10 (referred to herein as a "shifter"). The shifter 10 can comprise a first shaft segment 12 having a first end 14 and an opposing second end 16, a second shaft segment 18 having a first end 20 and an opposing second end 22, a third shaft segment 24 having a first end 26 and an opposing second end 28, and a fourth shaft segment 30 having a first end 32 and an opposing second end 34. The first and second shaft segments can be aligned and spaced apart in a longitudinal dimension 36, and the first end 14 of the first segment 12 can face the first end 20 of the second shaft segment 18. The third and fourth shaft segments can be aligned and spaced apart in the longitudinal dimension 36, and the first end 26 of the third segment 24 can face the first end 32 of the fourth shaft segment 30. The first and second shaft segments can be offset from the third and fourth shaft segments in a transverse dimension 38 that is perpendicular to the longitudinal dimension 36. Optionally, the transverse dimension 38 can be horizontal.

As further explained below, it is contemplated that the disclosed shifter adjuster assemblies can permit faster, safer, and more precise tensioning adjustments in comparison to conventional methods. More particularly, the disclosed shifter adjuster assemblies can be located under the head of the tufting machine, making the location of adjustment easily and safely accessible without the need for entering a guarded area or using tools that cause damage to the shifter shaft. Optionally, the disclosed shifter adjuster assemblies can make use of fine threads that permit more precise tensioning adjustment.

Figure 2:
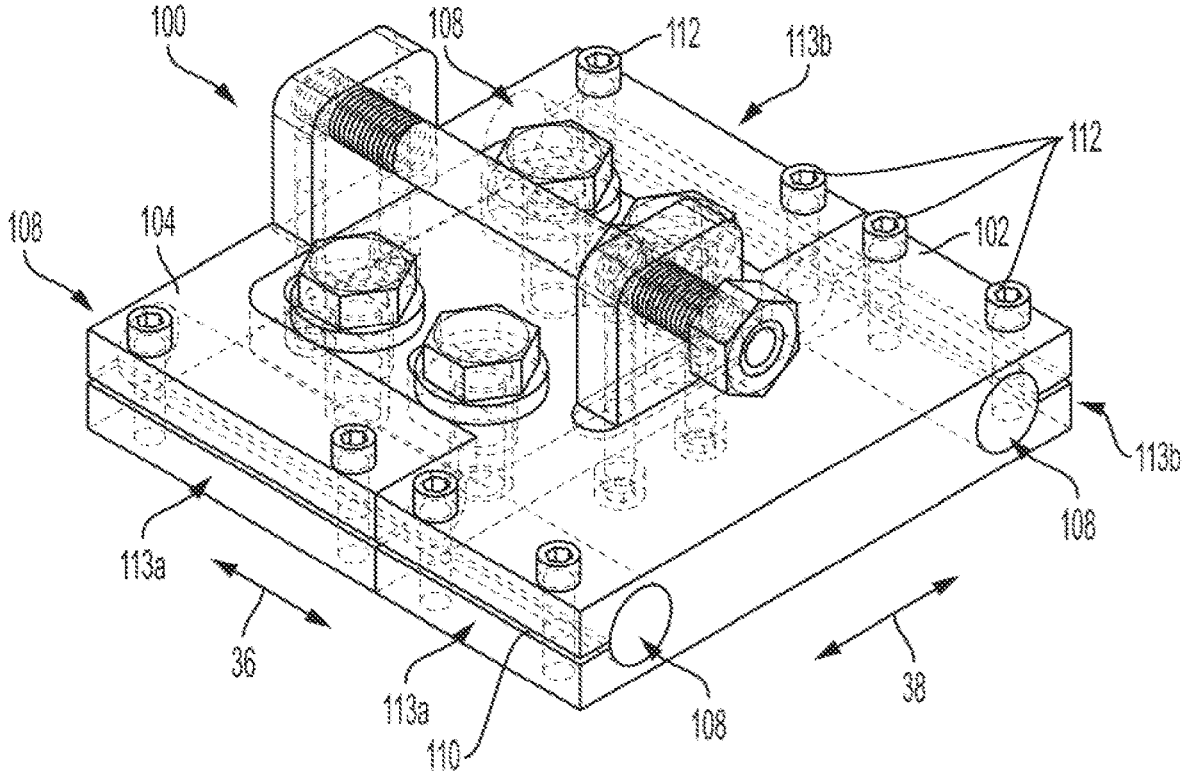
FIG. 2 is a perspective view of the shifter adjustment apparatus of FIG. 1.

Referring also to FIGS. 1 and 2, the shifter adjustment assembly 100 can comprise a first body 102 that can be coupled to the first end 14 of the first shaft segment 12 and the first end 26 of the third shaft segment 24. The shifter adjustment assembly 100 can further comprise a second body 104 that can be coupled to the first end 14 of the second shaft segment 12 and the first end 32 of the fourth shaft segment 30. For example, each of the first body 100 and second body 104 can define first and second through-bores 108 on opposing sides. Each of the first body and the second body 110 can have opposing first and second sides 113*a*, 113*b*. A slit 110 can extend inwardly from a respective side (e.g., the first or second side 113*a,b*) of the respective body to a respective through-bore 108. One or more fasteners 112 (e.g., screws) can extend through a clearance hole 114 on a first (e.g., upper) side of the slit 110 and engage a threaded hole 116 on an opposing second (e.g., lower) side of the slit 110. In this way, tightening the fasteners 112 in the threaded hole can compress the body to close the slit, thereby decreasing the inner diameter of the through bore 108 and frictionally engaging the respective shaft segment.

Referring to FIGS. 1-2 and 6-9, the first body 102 and second body 104 can be slidingly coupled so that movement between the first body 102 and the second body 104 in the transverse dimension 38 is restricted, but movement between the first body 102 and the second body 104 in the longitudinal dimension 36 is permitted. For example, the first body 102 can define a tongue 120 that can have a first longitudinally extending outer edge 122 and a second longitudinally extending outer edge 124 that is spaced from the first longitudinally extending outer edge 122 in the transverse dimension 38. The second body 104 can define a groove 126 having a first longitudinally extending inner edge 128 and a second longitudinally extending inner edge 130. The tongue 120 can be receivable into the groove with a small clearance in the transverse dimension between the groove 126 and the tongue 120 to inhibit transverse movement greater than the small clearance between the tongue and the groove. The first outer edge 122 of the tongue 120 can slidingly engage the first inner edge 128 of the groove 126, and the second outer edge 124 of the tongue 120 can slidingly engage the second inner edge 130 of the groove. Thus, the first inner edge 128 of the groove 126 can restrict the movement of the tongue in a first direction relative to the transverse dimension, and the second inner edge 130 of the groove 126 can restrict the movement of the tongue in an opposing second direction relative to the transverse dimension, yet the first and second inner edges can guide the longitudinal movement of the tongue 120, and thus, the first body 102.

It is further contemplated that many alternative structures known to those skilled in the art can slidingly couple the first body to the second body, such as, for example, a dowel rod that is fixedly coupled to the first body and slidably receivable within a bore of the second body.

Referring to FIGS. 1-2, a coupling 140 between the first body 102 and the second body 104 can secure the position of the first body with respect to the second body. For example, in some aspects, the coupling 140 can comprise one or more fasteners 142 (e.g., screws or bolts) and, optionally, washers 143. In some optional aspects, the tongue 120 of the first body 102 can define one or more slots 144 that are elongate in the longitudinal dimension 36. The second body 104 can define respective holes 146 (optionally, threaded holes) that are aligned in the transverse dimension with respective slots 144 along a portion of a longitudinal travel of the first body 102 relative to the second body 104. In some aspects, the fasteners 142 can threadedly engage the holes 146. In further aspects mot shown), the fasteners 142 can be bolts that are bolted through the holes 146 into correspond nuts. When the fasteners 142 are loosened, the first body 102 can slide relative to the second body 104 along the longitudinal dimension, optionally limited by the length of the slots in the longitudinal dimension. When the fasteners 142 are tightened down, the first body 102 can be held in a fixed position with respect to the second body.

Figure 3:
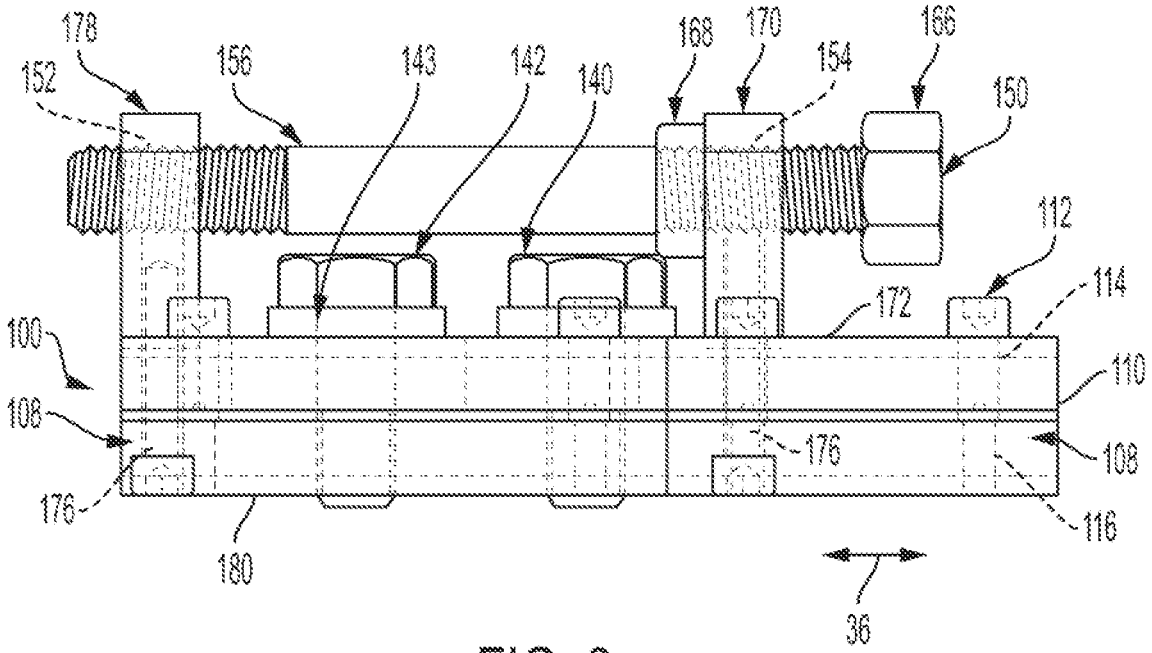
FIG. 3 is a side view of the shifter adjustment apparatus of FIG. 1.
Figure 4:
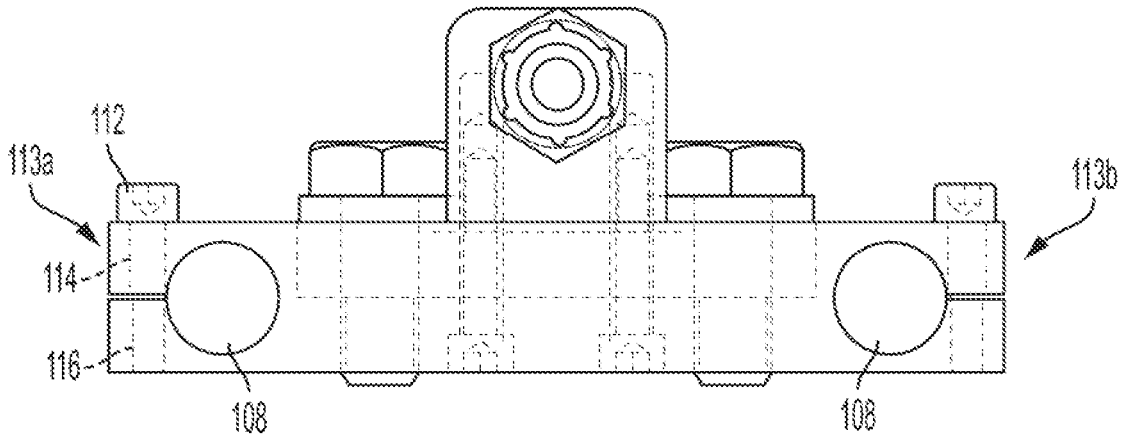
FIG. 4 is a rear view of the shifter adjustment apparatus of FIG. 1.
Figure 5:
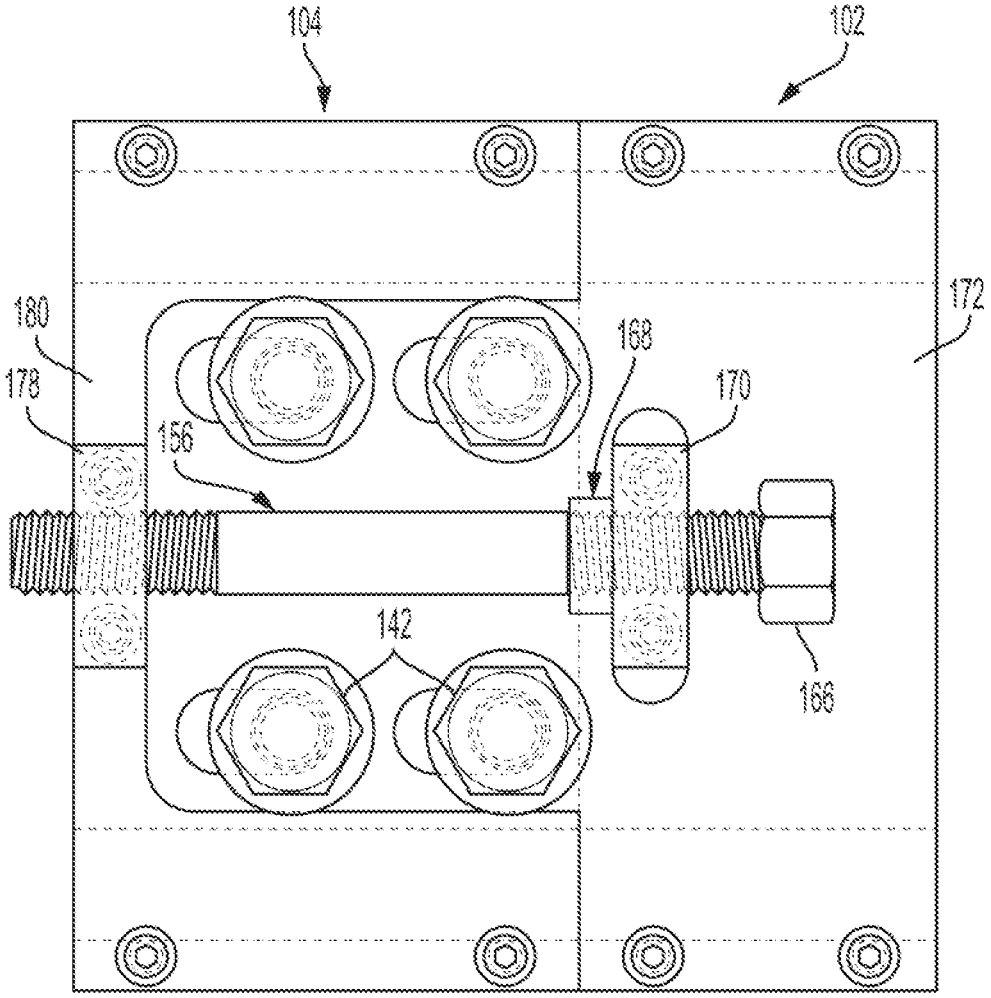
FIG. 5 is a top view of the shifter adjustment apparatus of FIG. 1.
Figure 6:
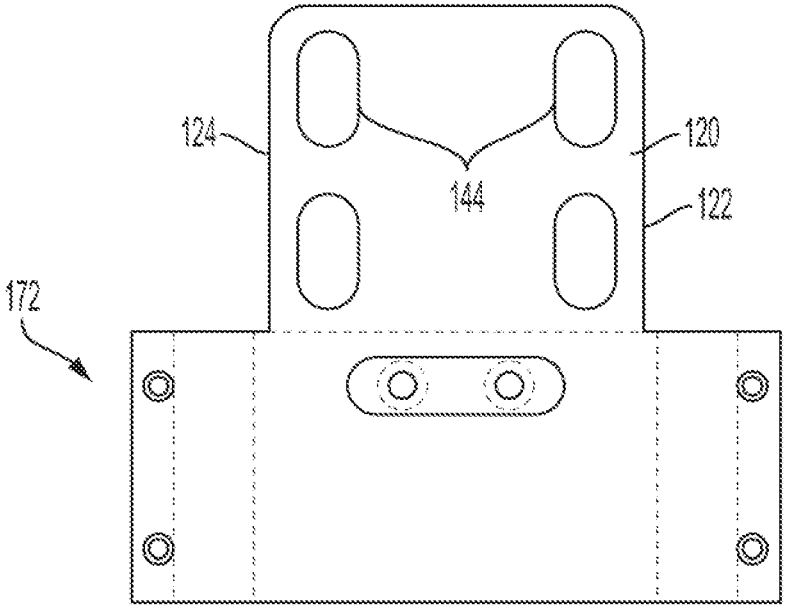
FIG. 6 is a top view of a first body of the shifter adjustment apparatus of FIG. 1.
Figure 7:
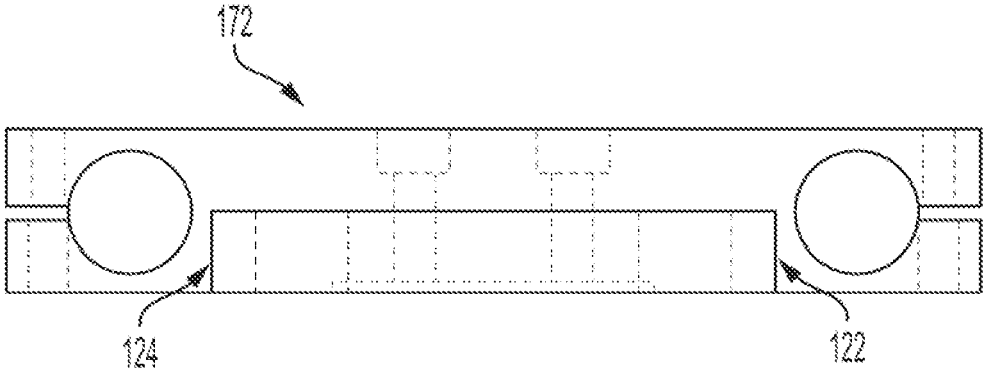
FIG. 7 is a front view of the first body of the shifter adjustment apparatus of FIG. 1.
Figure 8:
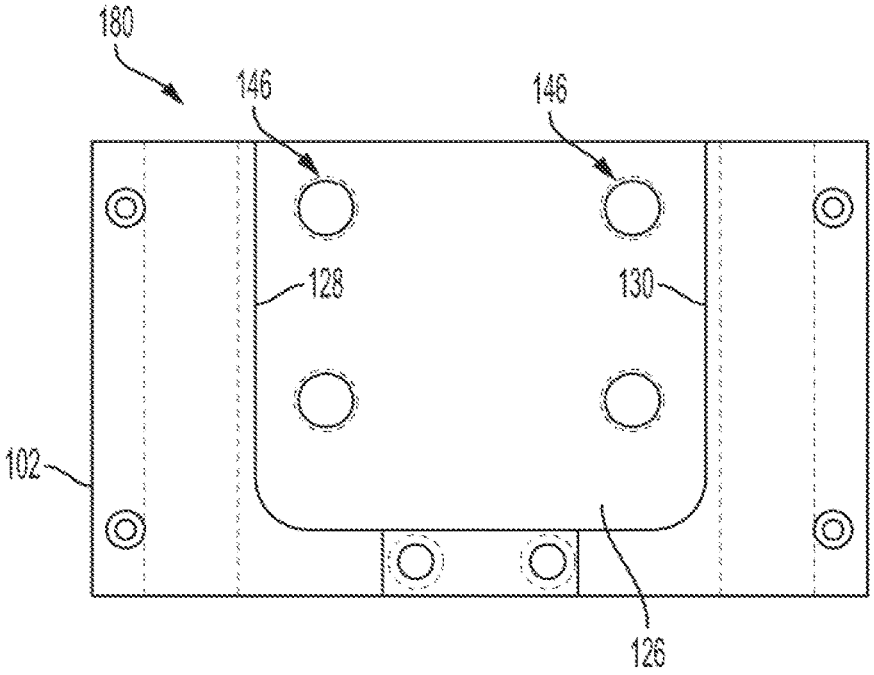
FIG. 8 is a top view of a second body of the shifter adjustment apparatus of FIG. 1.
Figure 9:
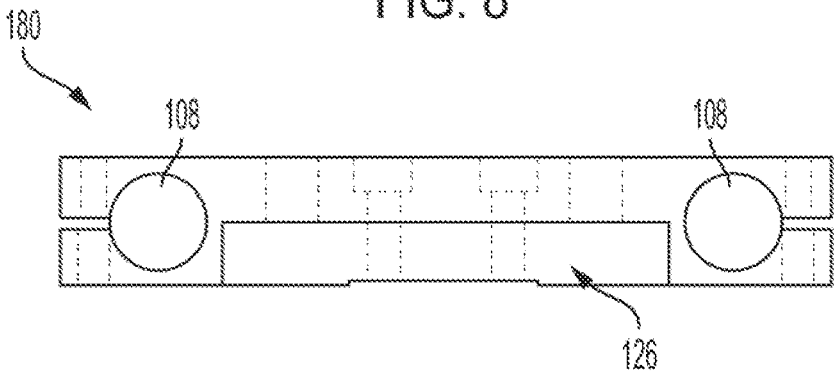
FIG. 9 is a rear view of the second body of the shifter adjustment apparatus of FIG. 1.
Figure 10:
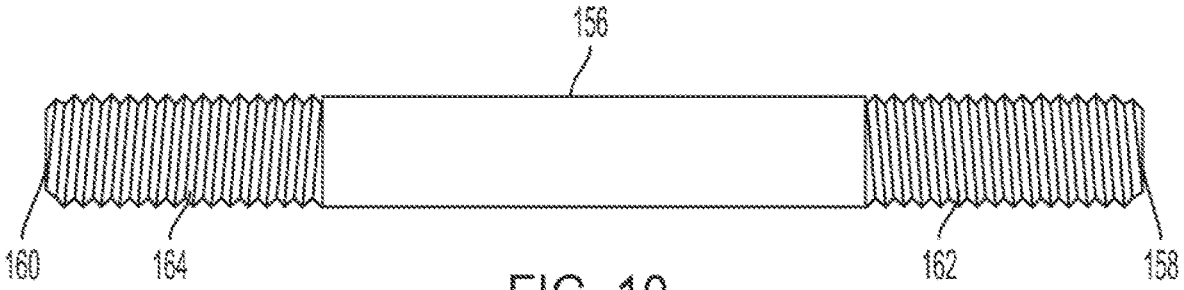
FIG. 10 is a side view of an elongate rod of the shifter adjustment apparatus of FIG. 1.
Figure 11:
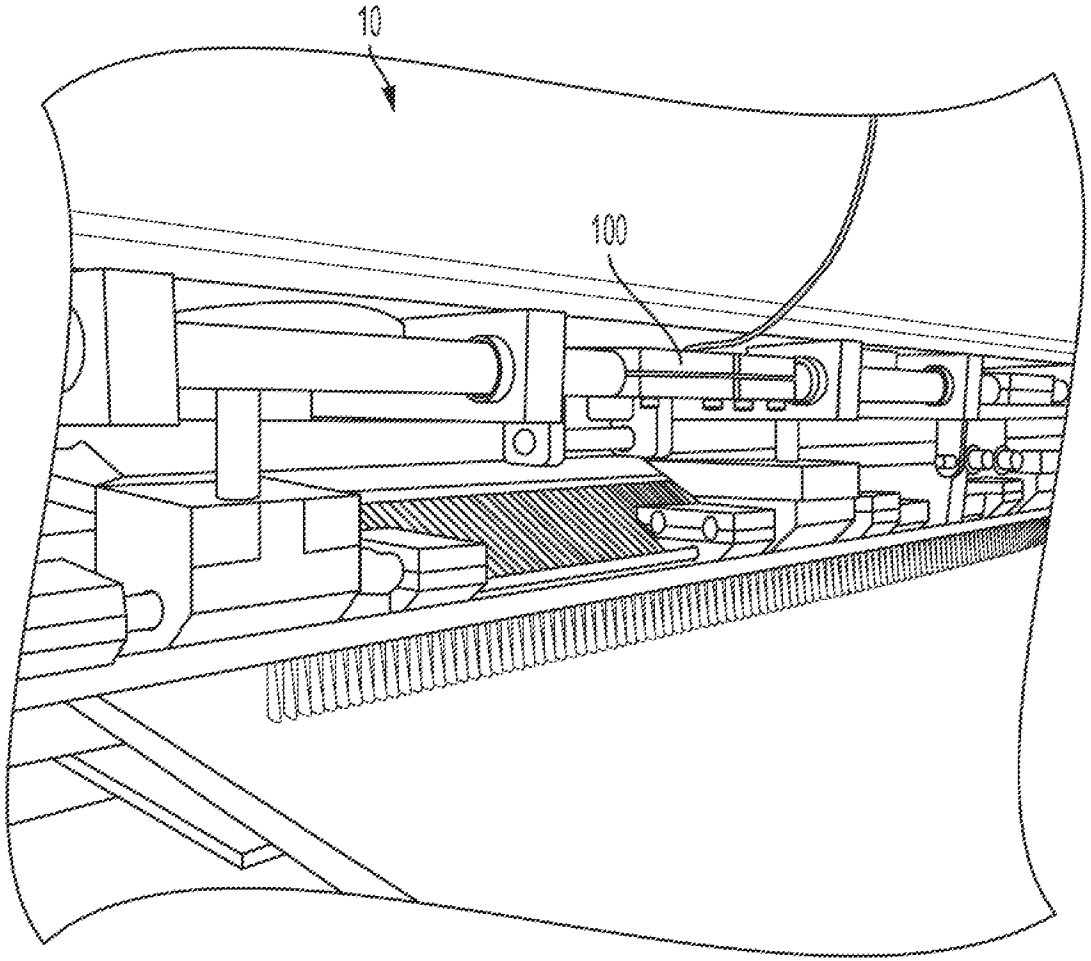
FIG. 11 is a perspective view of a portion of a needle bar shifter assembly having the shifter adjustment apparatus of FIG. 1.
Figure 12:
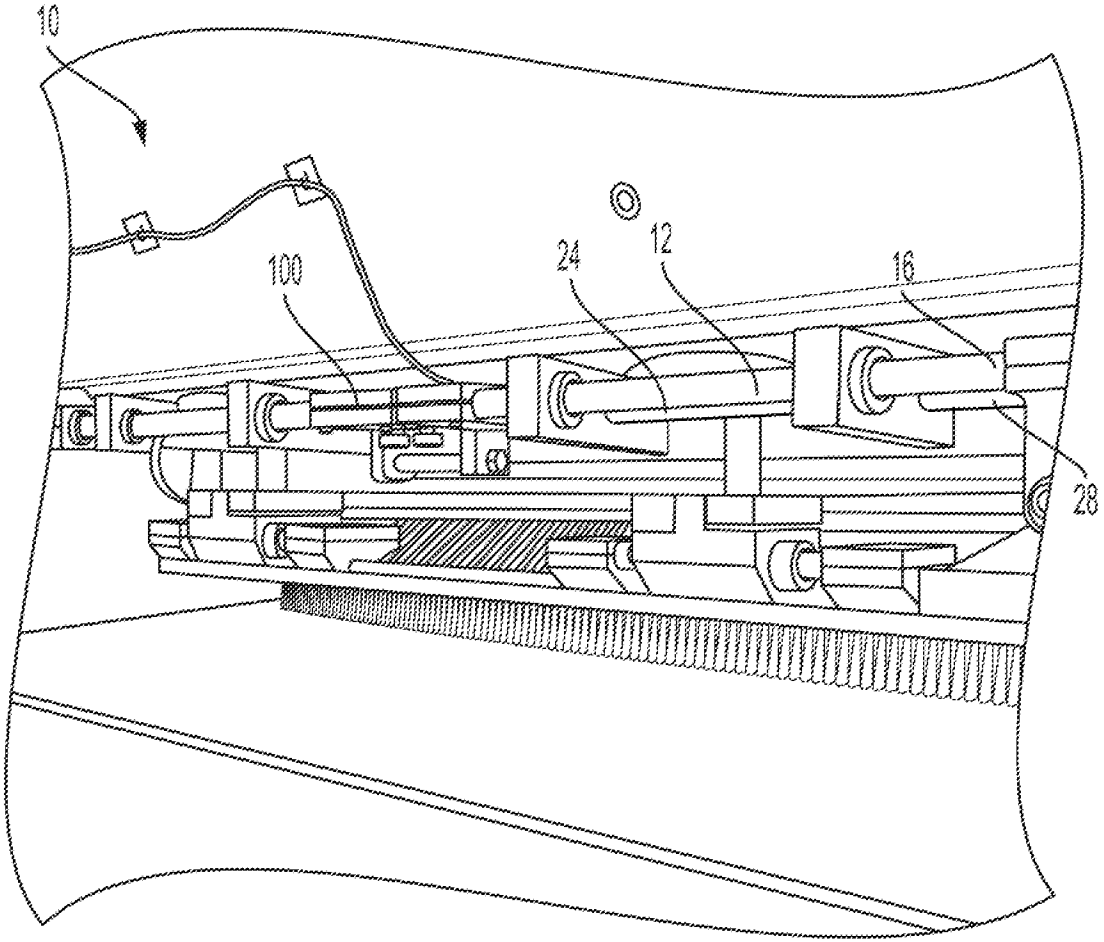
FIG. 12 is a perspective view of another portion of the needle bar shifter assembly having the shifter adjustment apparatus.
Figure 13:
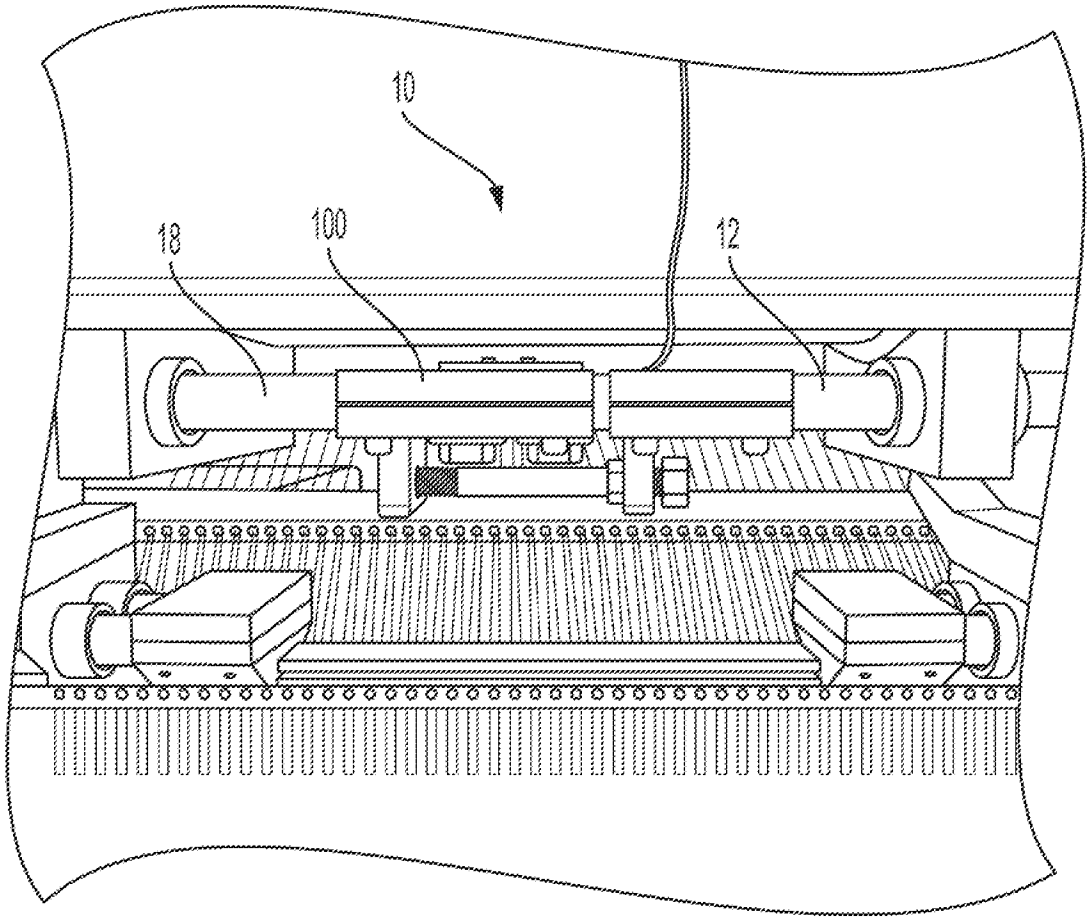
FIG. 13 is a front view of a portion of the needle bar shifter assembly.
Figure 14:
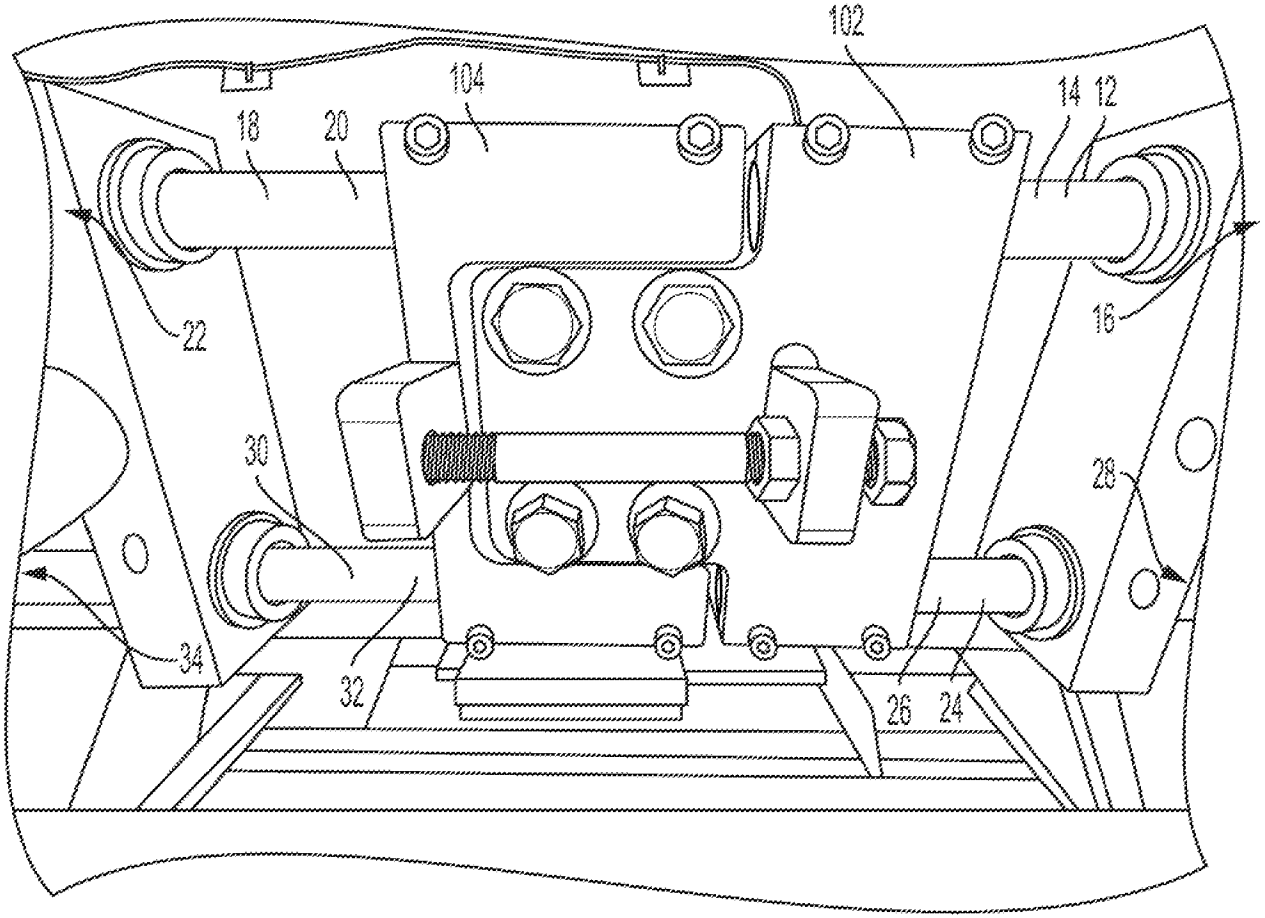
FIG. 14 is an underside view of the needle bar shifter assembly, showing the shifter adjustment apparatus.

Referring to FIGS. 1-3, in some aspects, the shifter adjustment assembly 100 can comprise an adjustment device 150. In some aspects, the first body can define a first through-hole 152 that extends through the first body in the longitudinal dimension. The first through-hole 152 can define one at least one right-handed thread. The second body 104 can comprise a second through-hole 154. The second through-hole 154 can define at least one left-handed thread. An elongate rod 156 can have a length, a first end 158, and an opposing second end 160. The elongate rod 156 can define right-handed thread(s) 162 on the first end and extending along a portion of the length of the elongate rod 150. The elongate rod 156 can define left-handed thread(s) 164 on the second end 160 and extending along a portion of the length of the elongate rod 150. The elongate rod can be threadedly coupled to, and extend between, the first body 102 and the second body 104. The right-handed thread(s) 162 of the elongate rod 156 can be threaded into the first through hole 152 of the first body, and the left-handed thread(s) 164 of the elongate rod can be threaded into the second hole 154 of the second body.

Rotation of the elongate rod in a first direction can cause the first body to move away from the second body in the longitudinal dimension, and rotation of the elongate rod in a second direction that is opposite the first direction can cause the first body to move toward the second body. Optionally, the elongate rod can define one or more gripping features, such as, for example, a hexagonal head 166, to facilitate rotation of the elongate rod. For example, a nut can be threaded onto one of the ends of the elongate rod 156 and then attached thereto via weldment. Optionally, a jam nut 168 can be threaded onto one of the ends of the elongate rod. The jam nut can be tightened down against a face of the respective body of the first and second body that shares the same thread(s) as the jam nut 168 to inhibit further rotation of the elongate rod with respect to either of the first or second bodies.

It is contemplated that the spacing between the first body 102 and the second body 104 can, in some circumstances, be critical. Accordingly, the clearance between the threads of the first through-hole 152 and the right-handed thread(s) 162, and the clearance between the thread(s) of the second through-hole 154 and the left-handed thread(s) 164 can be minimized so that no (or substantially no) longitudinal movement is allowed between the elongate rod and the first and second bodies. For example, the first through-hole 152 and the second through-hole 154 can define Unified Thread Class 3A threads, and the right- and left-handed thread(s) 162, 164 can define Unified. Thread Class 2B threads. In further aspects, all of the threads can be Class 3A. In this way, the exact spacing between the first and second bodies can be selected.

In some optional aspects, the first body 102 can comprise a first portion 170 and a second portion 172 that can be coupled to the first portion (e.g., via screws 176). The first portion can define the through-hole 152. The first portion 170 of the first body 102 can extend perpendicularly or generally perpendicularly from the second portion 172, such as, for example, vertically upward from an upper face of the second portion 172. Likewise, the second body 104 can comprise a first portion 178 and a second portion 180 that is coupled to the first portion (e.g., via screws 176). The first portion 178 of the first body 102 can extend perpendicularly or generally perpendicularly from the second portion 180, such as, for example, vertically upward from an upper face of the second portion 180.

Referring to FIG. 1, optionally, a linear position sensor 182 (e.g., a linear potentiometer) can be coupled between the first body 102 and the second body 104 so that their positions relative to each other in the longitudinal dimension can be known. For example, a first end of the linear position sensor 182 can couple to the first body 102, and a second end of the linear position sensor can couple to the second body 104. Optionally, the linear position sensor can be a capacitive scale having a resolution of, for example, 0.0005 inches. The linear position sensor can be in communication with a computing device (e.g., desktop computer, laptop, smartphone, tablet, etc.), a small LED display, or other output device to convey its sensed position to an operator.

Although the specification and figures describe certain features on the first body 102 and complementary features on the second body 104, it should be understood that the features can be reversed unless specifically stated in the claims. For example, it should be understood that, in some alternative aspects, the first body can define the groove 126, and the second body can comprise the tongue 120. In further alternative aspects, the first body 102 can define the left-handed thread(s) 164, and the second body 104 can define the light-handed thread(s) 162. Thus any feature stated in the claims should not be limited to its association with the first body or the second body unless the claims specifically state so.

Conventionally, both of the original shafts of the shifter of the tufting machine extend along the longitudinal length of the tufting machine. Thus, to attach the shifter adjustment assembly 100, it is contemplated that the shafts can be cut to provide the first, second, third, and fourth shafts segments. It is further contemplated that the original shafts can be removed and replaced with shorter segments (i.e., the first, second, third, and fourth shaft segments) that, when coupled to the shifter adjustment assembly 100, provide the same length, or substantially the same length, as the original shafts of the shifter assembly. The first and third shaft segments can be inserted into the respective through-bores 108 of the first body, and the fasteners 112 can be tightened down. Likewise, the second and fourth shaft segments can be inserted into the respective through-bores 108 of the second body, and the fasteners 112 can be tightened down.

To adjust the needle tension with the shifter adjustment assembly, an operator can first verify that the needles are in an up position and not crossing over any hooks of the tufting machine. It can be desirable for the bracket not to be under tension or compression during adjustment. The tufting machine can be locked out for safety.

The jam nut 168 can be loosened from against the first or second body, and the slide fasteners 142 can be loosened to enable movement between the first and second body. Using a wrench, an operator can rotate the tension adjustment nut to adjust the position of the first body relative to the second body in the longitudinal dimension. For example, to increase tension on the needles, the first and second bodies can be moved toward each other. To decrease tension, the first and second bodies can be moved away from each other. Adjustment between the first and second bodies can shift the needle bar relative to the hook bar, thereby adjusting the positions of the needles with relative to their respective hooks. Optionally, the linear position sensor can output a readout, and the operator can select the relative position between the first and second body based on a desired readout from the linear position sensor.

Once the select position is achieved, the jam nut can be tightened against a respective body. The fasteners 142 can be tightened down (e.g., to about 60 ft-lbs) to hold the first and second bodies in their relative positions. The tufting machine can be locked out to put the machine back in production.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A shifter adjustment assembly that is configured to couple to a shifter of a tufting apparatus, the shifter having first, second, third, and fourth shaft segments, each of the first, second, third, and fourth shaft segments having respective first and second ends, the first and second shaft segments being aligned and spaced apart in a longitudinal dimension, the third and fourth shaft segments being aligned and spaced apart in the longitudinal dimension, the first ends of the first and second shaft segments facing one another, the first ends of the third and fourth shaft segments facing one another, the third and fourth shaft segments being offset from the first and second shaft segments in a transverse dimension that is perpendicular to the longitudinal dimension, the shifter adjustment assembly comprising: a first body that is configured to couple to the first ends of the first and third shaft segments; a second body that is configured to couple to the first ends of the second and fourth shaft segments; a coupling between the first body and the second body, wherein the coupling is configured to releasably secure an axial position of the first body with respect to the second body along the longitudinal dimension, wherein the first body and second body define respective complementary surfaces that are configured for sliding engagement so that: movement between the first body and the second body in the transverse dimension is restricted; and movement between the first body and the second body in the longitudinal dimension is permitted.

Aspect 2: The shifter adjustment assembly of aspect 1, further comprising an adjustment device configured to move the first body with respect to the second body in the longitudinal dimension.

Aspect 3: The shifter adjustment assembly of aspect 2, wherein the first body defines a first through-hole that extends through the first body in the longitudinal dimension, wherein the second body defines a second through-hole that extends through the second body in the longitudinal dimension, wherein the first through-hole defines a right-hand thread, wherein the second hole defines a left-hand thread, wherein the adjustment device comprises an elongate rod having a right-hand thread on a first end and a left-hand thread on a second end opposite the first end, wherein the right-hand thread of the first end of the elongate rod is in engagement with the right hand thread of the first body, and the left-hand thread of the second end of the elongate rod is in engagement with the left-hand thread of the second body.

Aspect 4: The shifter adjustment assembly of aspect 3, further comprising a hexagonal head coupled to the elongate rod.

Aspect 5: The shifter adjustment assembly of aspect 3 or aspect 4, wherein the adjustment device further comprises a jam nut that is threadedly movable on the elongate rod and configured to bias against one of the first body or the second body.

Aspect 6: The shifter adjustment assembly of any one of aspects 3-5, wherein the first body comprises a first portion and a second portion that is coupled to the first portion, wherein the first portion of the first body defines the first through-hole that defines the right-hand thread, wherein the second body comprises a first portion and a second portion that is coupled to the first portion, wherein the first portion of the second body defines the second through-hole that defines the left-hand thread.

Aspect 7: The shifter adjustment assembly of aspect 6, wherein the first portion of the first body extends upwardly from the second portion of the first body, wherein first portion of the second body extends upwardly from the second portion of the second body.

Aspect 8: The shifter adjustment assembly of any one of the preceding aspects, wherein the coupling between the first body and the second body comprises at least one fastener.

Aspect 9: The shifter adjustment assembly of aspect 9, wherein one of the first body and the second body defines a respective slot that is elongate in the longitudinal dimension through which each fastener of the at least one fastener extends.

Aspect 10: The shifter adjustment assembly of any one of the preceding aspects: wherein the first body defines a first longitudinally extending through-bore for receiving the first shaft segment, and wherein the first body defines a second longitudinally extending through-bore for receiving the second shall segment.

Aspect 11: The shifter adjustment assembly of aspect 10: wherein the first body defines a first slit that extends between a first side of the first body and the first longitudinally extending through-bore, wherein the first body defines a second slit that extends between a second side of the first body and the second longitudinally extending through-bore, wherein the shifter adjustment assembly comprises at least one threaded fastener that extends across the first slit of the first body, wherein the at least one threaded fastener that extends across the first slit of the first body threadedly couples to the first body so that a tightening of the at least one threaded fastener that extends across the first slit of the first body causes the first longitudinally extending through-bore to tighten against the first shaft segment, and wherein the shifter adjustment assembly comprises at least one threaded fastener that extends across the second slit of the first body, wherein the at least one threaded fastener that extends across the second slit of the first body threadedly couples to the first body so that a tightening of the at least one threaded fastener that extends across the second slit of the first body causes the second longitudinally extending through-bore to tighten against the third shaft segment.

Aspect 12: The shifter adjustment assembly of any one of the preceding aspects: wherein the second body defines a first longitudinally extending through-bore for receiving the second shaft segment, and wherein the second body defines a second longitudinally extending through-bore for receiving the fourth shaft segment.

Aspect 13: The shifter adjustment assembly of aspect 12: wherein the second body defines a first slit that extends between a first side of the second body and the first longitudinally extending through-bore, wherein the second body defines a second slit that extends between a second side of the second body and the second longitudinally extending through-bore, wherein the shifter adjustment assembly comprises at least one threaded fastener that extends across the first slit of the second body, wherein the at least one threaded fastener that extends across the first slit of the second body threadedly couples to the first body so that a tightening of the at least one threaded fastener that extends across the first slit of the second body causes the first longitudinally extending through-bore to tighten against the second shaft segment, and wherein the shifter adjustment assembly comprises at least one threaded fastener that extends across the second slit of the second body, wherein the at least one threaded fastener that extends across the second slit of the second body threadedly couples to the first body so that a tightening of the at least one threaded fastener that extends across the second slit of the second body causes the second longitudinally extending through-bore to tighten against the fourth shaft segment.

Aspect 14: The shifter adjustment assembly of any one of the preceding aspects, wherein the first body defines one of a tongue or a groove, and the second body defines the other of the tongue and the groove, wherein the tongue is receivable into the groove with a clearance in the transverse dimension between the groove and the tongue that inhibits transverse movement between the tongue and the groove.

Aspect 15: The shifter adjustment assembly of aspect 14, wherein the tongue defines first and second longitudinally extending outer edges, wherein the groove defines corresponding first and second longitudinally extending inner edges that are outward of the respective outer edge of the first and second outer edges of the tongue relative to the transverse dimension, wherein the first and second outer edges of the groove respectively slidingly engage the first and second inner edges of the tongue to thereby restrict movement between the first body and the second body in the transverse dimension.

Aspect 16: The shifter adjustment assembly of any one of the preceding aspects, further comprising a linear position sensor that is configured to detect at least one of a distance or a change in distance between the first body and the second body relative to the longitudinal dimension.

Aspect 17: A method of coupling a shifter adjustment assembly as in any one of the preceding aspects to a tufting machine having a longitudinal dimension that is perpendicular to a transverse dimension, the tufting machine comprising a shifter having a first end and a second end, the shifter comprising: a first continuous shaft that extends between the first and second ends of the shifter and a second continuous shaft that extends between the first and second ends of the shifter, the method comprising: modifying or replacing the first continuous shaft of the shifter to provide the first shaft segment and the second shaft segment; modifying or replacing the second continuous shaft of the shifter to provide the third shaft segment and the fourth shaft segment; and coupling the shifter adjustment assembly to the first, second, third, and fourth shaft segments.

Aspect 18: The method of aspect 17, wherein the first continuous shaft is removed and replaced with the first shaft segment and the second shaft segment, and wherein the second continuous shaft is removed and replaced with the third shaft segment and the fourth shaft segment.

Aspect 19: The method of aspect 17, wherein the first continuous shaft is cut to produce the first shaft segment and the second shaft segment, and wherein the second continuous shaft is cut to produce the third shaft segment and the fourth shaft segment.

Aspect 20: A method of using a shifter adjustment assembly as in one of aspects 2-16, the method comprising: adjusting the position of the first body with respect to the second body and securing the position of the first body with respect to the second body.

Aspect 21: The method of aspect 20, wherein the shifter adjustment assembly is a shifter adjustment assembly as in any one of aspects 3-16, wherein adjusting the position of the first body with respect to the second body comprises rotating the elongate rod to adjust the position of the first body with respect to the second body.

Aspect 22: The method of aspect 20 or aspect 21, wherein the shifter adjustment assembly is a shifter adjustment assembly as in one of aspects 8-16 wherein securing a position of the first body with respect to the second body comprises tightening each fastener (e.g., threaded fastener) that couples (e.g., fixedly couples) the first body to the second body.

Aspect 23: A tufting apparatus having a longitudinal dimension that is perpendicular to a transverse dimension, the tufting apparatus comprising: a shifter comprising: first, second, third, and fourth shaft segments, each of the first, second, third, and fourth shaft segments having respective first and second ends, wherein the first and second shaft segments are aligned and spaced apart in a longitudinal dimension, wherein the third and fourth shaft segments are aligned and spaced apart in the longitudinal dimension, wherein the first ends of the first and second shaft segments face one another, wherein the first ends of the third and fourth shaft segments face one another, wherein the third and fourth shaft segments are offset from the first and second shaft segments in a transverse dimension that is perpendicular to the longitudinal dimension; and a shifter adjustment assembly as in any one of aspects 1-16, wherein the first body is coupled to the first end of the first shaft segment and the first end of the third shaft segment, wherein the second body is coupled to the first end of the second shaft segment and the first end of the fourth shaft segment.

Although the foregoing invention has been described in some detail by way of illustration and example for purposes of clarity of understanding, certain changes and modifications may be practiced within the scope of the appended claims.

What is claimed is:

1. A shifter adjustment assembly that is configured to couple to a shifter of a tufting apparatus, the shifter having first, second, third, and fourth shaft segments, each of the first, second, third, and fourth shaft segments having respective first and second ends, the first and second shaft segments being aligned and spaced apart in a longitudinal dimension, the third and fourth shaft segments being aligned and spaced apart in the longitudinal dimension, the first ends of the first and second shaft segments facing one another, the first ends of the third and fourth shaft segments facing one another, the third and fourth shaft segments being offset from the first and second shaft segments in a transverse dimension, the shifter adjustment assembly comprising:

a first body that is configured to couple to the first ends of the first and third shaft segments;

a second body that is configured to couple to the first ends of the second and fourth shaft segments; and a coupling between the first body and the second body, wherein the coupling is configured to releasably secure an axial position of the first body with respect to the second body along the longitudinal dimension, wherein the first body and second body define respective complementary surfaces that are configured for sliding engagement so that:

movement between the first body and the second body in the transverse dimension is restricted; and movement between the first body and the second body in the longitudinal dimension is permitted, and wherein the first body is configured to couple to the first ends of the first and third shaft segments and the second body is configured to couple to the first ends of the second and fourth shaft segments so that, when the first ends of the first and third shaft segments are coupled to the first body and the first ends of the second and fourth shaft segments are coupled to the second body, movement between the first body and the second body in the longitudinal dimension effects corresponding relative movement along the longitudinal dimension between:

the first and second shaft segments, and the third and fourth shaft segments.

2. The shifter adjustment assembly of claim 1, further comprising an adjustment device configured to move the first body with respect to the second body in the longitudinal dimension.

3. The shifter adjustment assembly of claim 2, wherein the first body defines a first through-hole that extends through the first body in the longitudinal dimension, wherein the second body defines a second through-hole that extends through the second body in the longitudinal dimension, wherein the first through-hole defines a right-hand thread, wherein the second through-hole defines a left-hand thread, wherein the adjustment device comprises an elongate rod having a right-hand thread on a first end and a left-hand thread on a second end opposite the first end, wherein the right-hand thread of the first end of the elongate rod is in engagement with the right hand thread of the first through-hole, and the left-hand thread of the second end of the elongate rod is in engagement with the left-hand thread of the second through-hole.

4. The shifter adjustment assembly of claim 3, further comprising a hexagonal head coupled to the elongate rod.

5. The shifter adjustment assembly of claim 3, wherein the adjustment device further comprises a jam nut that is threadedly movable on the elongate rod and configured to bias against one of the first body or the second body.

6. The shifter adjustment assembly of claim 3, wherein the first body comprises a first portion and a second portion that is coupled to the first portion, wherein the first portion of the first body defines the first through-hole that defines the right-hand thread, wherein the second body comprises a first portion and a second portion that is coupled to the first portion, wherein the first portion of the second body defines the second through-hole that defines the left-hand thread.

7. The shifter adjustment assembly of claim 6, wherein the first portion of the first body extends upwardly from the second portion of the first body, wherein the first portion of the second body extends upwardly from the second portion of the second body.

8. The shifter adjustment assembly of claim 1, wherein the coupling between the first body and the second body comprises at least one fastener.

9. The shifter adjustment assembly of claim 8, wherein one of the first body and the second body defines at least one slot that is elongate in the longitudinal dimension, wherein each fastener of the at least one fastener extends through a respective slot of the at least one slot.

10. The shifter adjustment assembly of claim 1:

wherein the first body defines a first longitudinally extending through-bore for receiving the first shaft segment, wherein the first body defines a second longitudinally extending through-bore for receiving the third shaft segment, wherein the second body defines a first longitudinally extending through-bore for receiving the second shaft segment, and wherein the second body defines a second longitudinally extending through-bore for receiving the fourth shaft segment.

11. The shifter adjustment assembly of claim 10:

wherein the first body defines a first slit that extends between a first side of the first body and the first longitudinally extending through-bore, wherein the first body defines a second slit that extends between a second side of the first body and the second longitudinally extending through-bore, wherein the shifter adjustment assembly comprises at least one threaded fastener that extends across the first slit of the first body, wherein the at least one threaded fastener that extends across the first slit of the first body threadedly couples to the first body so that a tightening of the at least one threaded fastener that extends across the first slit of the first body causes the first longitudinally extending through-bore to tighten against the first shaft segment, and wherein the shifter adjustment assembly comprises at least one threaded fastener that extends across the second slit of the first body, wherein the at least one threaded fastener that extends across the second slit of the first body threadedly couples to the first body so that a tightening of the at least one threaded fastener that extends across the second slit of the first body causes the second longitudinally extending through-bore to tighten against the third shaft segment.

12. The shifter adjustment assembly of claim 10:

wherein the second body defines a first slit that extends between a first side of the second body and the first longitudinally extending through-bore, wherein the second body defines a second slit that extends between a second side of the second body and the second longitudinally extending through-bore, wherein the shifter adjustment assembly comprises at least one threaded fastener that extends across the first slit of the second body, wherein the at least one threaded fastener that extends across the first slit of the second body threadedly couples to the first body so that a tightening of the at least one threaded fastener that extends across the first slit of the second body causes the first longitudinally extending through-bore to tighten against the second shaft segment, and wherein the shifter adjustment assembly comprises at least one threaded fastener that extends across the second slit of the second body, wherein the at least one threaded fastener that extends across the second slit of the second body threadedly couples to the first body so that a tightening of the at least one threaded fastener that extends across the second slit of the second body causes the second longitudinally extending through-bore to tighten against the fourth shaft segment.

13. The shifter adjustment assembly of claim 1, wherein the first body defines one of a tongue or a groove, and the second body defines the other of the tongue and the groove, wherein the tongue is receivable into the groove with a clearance in the transverse dimension between the groove and the tongue that inhibits transverse movement between the tongue and the groove.

14. The shifter adjustment assembly of claim 13, wherein the tongue defines first and second longitudinally extending outer edges, wherein the groove defines corresponding first and second longitudinally extending inner edges that are outward of the respective outer edge of the first and second outer edges of the tongue relative to the transverse dimension, wherein the first and second inner edges of the groove respectively slidingly engage the first and second outer edges of the tongue to thereby restrict movement between the first body and the second body in the transverse dimension.

15. The shifter adjustment assembly of claim 1, further comprising a linear position sensor that is configured to detect at least one of a distance or a change in distance between the first body and the second body relative to the longitudinal dimension.

16. The shifter adjustment assembly of claim 1, wherein the transverse dimension is perpendicular to the longitudinal dimension.

17. A method of coupling a shifter adjustment assembly to a tufting machine having a longitudinal dimension that is perpendicular to a transverse dimension, the tufting machine comprising a shifter having a first end and a second end, the shifter comprising a first continuous shaft that extends between the first and second ends of the shifter and a second continuous shaft that extends between the first and second ends of the shifter, the method comprising:

modifying or replacing the first continuous shaft of the shifter to provide a first shaft segment and a second shaft segment;

modifying or replacing the second continuous shaft of the shifter to provide a third shaft segment and a fourth shaft segment; and coupling a shifter adjustment assembly to the first, second, third, and fourth shaft segments, wherein the shifter adjustment assembly comprises:

a first body that is configured to couple to the first ends of the first and third shaft segments;

a second body that is configured to couple to the first ends of the second and fourth shaft segments; and a coupling between the first body and the second body, wherein the coupling is configured to releasably secure an axial position of the first body with respect to the second body along the longitudinal dimension, wherein the first body and second body define respective complementary surfaces that are configured for sliding engagement so that:

movement between the first body and the second body in the transverse dimension is restricted; and movement between the first body and the second body in the longitudinal dimension is permitted.

18. The method of claim 17, wherein the first continuous shaft is removed and replaced with the first shaft segment and the second shaft segment, and wherein the second continuous shaft is removed and replaced with the third shaft segment and the fourth shaft segment.

19. The method of claim 17, wherein the first continuous shaft is cut to produce the first shaft segment and the second shaft segment, and wherein the second continuous shaft is cut to produce the third shaft segment and the fourth shaft segment.

20. A tufting apparatus having a longitudinal dimension and a transverse dimension, the tufting apparatus comprising:

a shifter comprising:

first, second, third, and fourth shaft segments, each of the first, second, third, and fourth shaft segments having respective first and second ends, wherein the first and second shaft segments are aligned and spaced apart in a longitudinal dimension, wherein the third and fourth shaft segments are aligned and spaced apart in the longitudinal dimension, wherein the first ends of the first and second shaft segments face one another, wherein the first ends of the third and fourth shaft segments face one another, wherein the third and fourth shaft segments are offset from the first and second shaft segments in a transverse dimension that is perpendicular to the longitudinal dimension; and a shifter adjustment assembly comprising:

a first body that is configured to couple to the first ends of the first and third shaft segments;

a second body that is configured to couple to the first ends of the second and fourth shaft segments;

a coupling between the first body and the second body, wherein the coupling is configured to releasably secure an axial position of the first body with respect to the second body along the longitudinal dimension, wherein the first body and second body define respective complementary surfaces that are configured for sliding engagement so that:

movement between the first body and the second body in the transverse dimension is restricted; and movement between the first body and the second body in the longitudinal dimension is permitted, wherein the first body is coupled to the first end of the first shaft segment and the first end of the third shaft segment and the second body is coupled to the first end of the second shaft segment and the first end of the fourth shaft segment so that movement between the first body and the second body in the longitudinal dimension effects corresponding relative movement along the longitudinal dimension between:

the first and second shaft segments, and the third and fourth shaft segments.

* * * * *